US008144908B2

(12) United States Patent
Åsnes

(10) Patent No.: US 8,144,908 B2
(45) Date of Patent: Mar. 27, 2012

(54) METHOD AND AN ARRANGEMENT FOR DAMPING A RESONANCE FREQUENCY

(75) Inventor: Kristian Åsnes, Mölndal (SE)

(73) Assignee: Cochlear Bone Anchored Solutions AB, Molnlycke (SE)

( * ) Notice: Subject to any disclaimer, the term of this patent is extended or adjusted under 35 U.S.C. 154(b) by 1070 days.

(21) Appl. No.: 10/572,459

(22) PCT Filed: Sep. 15, 2004

(86) PCT No.: PCT/SE2004/001321

§ 371 (c)(1),
(2), (4) Date: Aug. 4, 2008

(87) PCT Pub. No.: WO2005/029915

PCT Pub. Date: Mar. 31, 2005

(65) Prior Publication Data

US 2008/0292125 A1 Nov. 27, 2008

(30) Foreign Application Priority Data

Sep. 19, 2003 (SE) ..... 0302489

(51) Int. Cl.
*H04R 25/00* (2006.01)

(52) U.S. Cl. ..... 381/326; 381/151; 381/312

(58) Field of Classification Search ..... 381/326, 381/328, 322, 318

See application file for complete search history.

(56) References Cited

U.S. PATENT DOCUMENTS 4,498,461 A 2/1985 Hakansson
4,904,233 A 2/1990 Håkansson et al.
5,091,952 A * 2/1992 Williamson et al. ..... 381/318
6,466,678 B1 * 10/2002 Killion et al. ..... 381/314
6,643,378 B2 * 11/2003 Schumaier ..... 381/326
2002/0122563 A1 9/2002 Schumaier
2004/0028249 A1 2/2004 Asnes (Continued)

FOREIGN PATENT DOCUMENTS

JP 55-038733 A 3/1980

(Continued)

OTHER PUBLICATIONS

Peder U. Carlsson; On Direct Bone Conduction Hearing Devices; advances in transducer technology and measurement methods; Technical Report No. 195; Mar. 1990.

(Continued)

*Primary Examiner* — Curtis Kuntz
*Assistant Examiner* — Sunita Joshi
(74) *Attorney, Agent, or Firm* — Kilpatrick, Townsend & Stockton, LLP.

(57) ABSTRACT

A method and an arrangement for damping the resonance frequency in a vibrator for bone anchored hearing aids in which sound information is mechanically transmitted via the skull bone directly to the inner ear of a person with impaired hearing. A microphone picks up the sound, a signal processor amplifies and filters the signal from the microphone and a vibrator converts the electrical signal into vibrations. The signal processor of the hearing aid is used for damping the resonance frequency peak of the vibrator. For this purpose the signal processor includes electronic filters that are arranged to reduce the amplification in the signal processing chain of the hearing aid as much as the desired dampening of the resonance frequency peak of the vibrator.

18 Claims, 2 Drawing Sheets

U.S. PATENT DOCUMENTS

| | | | | |
|---|---|---|---|---|
| 2004/0032962 | A1 | 2/2004 | Westerkull | |
| 2004/0057588 | A1 | 3/2004 | Asnes | |
| 2004/0234091 | A1 * | 11/2004 | Westerkull | 381/328 |
| 2004/0236176 | A1 | 11/2004 | Asnes | |
| 2005/0123157 | A1 | 6/2005 | Kragelund et al. | |

FOREIGN PATENT DOCUMENTS

| | | | |
|---|---|---|---|
| SE | 8502426-3 | B | 12/1986 |
| WO | WO 83/02862 | | 8/1983 |
| WO | WO 01/93635 | A1 | 12/2001 |
| WO | WO 03/001846 | A1 | 1/2003 |
| WO | WO 03/049495 | | 6/2003 |
| WO | WO 2005/029915 | A1 | 3/2005 |

OTHER PUBLICATIONS

Anders Tjellström et al.; The Bone-Anchored Hearing Aid, Design Principles, Indications, and Long-Term Clinical Results; Otolaryngologic Clinics of North America; vol. 28, No. 1, Feb. 1995; pp. 53-72.

PCT/ISA/237—Written Opinion of the International Searching Authority—Dec. 21, 2004.

PCT/ISA/210—International Search Report—Dec. 21, 2004.

European Application No. 04775425.4, Correspondence regarding the termination of the opposition mailed on Aug. 12, 2010, 3 Pages.

European Application No. 04775425.4, Opposition mailed on Aug. 28, 2008, 7 Pages.

European Application No. 04775425.4, Notice of Intent to Grant mailed on May 9, 2007, 16 Pages.

International Application No. PCT/SE2004/001321, International Preliminary Report on Patentability mailed on Mar. 21, 2006, 6 Pages.

* cited by examiner

METHOD AND AN ARRANGEMENT FOR DAMPING A RESONANCE FREQUENCY

CROSS-REFERENCE TO RELATED APPLICATIONS

This application claims priority to Swedish patent application no. 0302489-0 filed 19 Sep. 2003 and is the national phase under 35 U.S.C. §371 of PCT/SE2004/001321.

FIELD OF THE INVENTION

The present invention relates to a method and an arrangement for damping the resonance frequency in a vibrator for a bone anchored hearing aid, i e a hearing aid of the type in which the sound information is mechanically transmitted via the skull bone directly to the inner ear of a person with impaired hearing. The vibrator can be used for conventional, bone anchored as well as implantable bone con-ducting hearing aids.

BACKGROUND OF THE INVENTION

For persons with impaired hearing, the hearing aid devices which are most commonly used today are those based on the principle that the sound is amplified and fed into the auditory meatus and stimulates the eardrum from the outside. In order to prevent acoustic feedback problems in these devices, the auditory meatus is almost completely plugged by a hearing plug or by the hearing aid device itself. This causes the user a feeling of pressure, discomfort, and sometimes even eczema. In some cases it even causes the user problems like running ears due to chronic ear inflammations or infections in the auditory canal.

However, there are other types of sound transmitting hearing aids on the market, i e bone anchored hearing aids which mechanically transmit the sound information to a persons inner ear via the skull bone by means of a vibrator. The hearing aid device is connected to an implanted titanium screw installed in the bone behind the external ear and the sound is transmitted via the skull bone to the cochlea (inner ear), i e the hearing aid works irrespective of a disease in the middle ear or not. The bone anchoring principle means that the skin is penetrated which makes the vibratory transmission very efficient.

This type of hearing aid device has been a revolution for the rehabilitation of patients with certain types of impaired hearing. It is very convenient for the patient and almost invisible with normal hair styles. It can easily be connected to the implanted titanium fixture by means of a bayonet coupling or a snap in coupling. One example of this type of hearing aid device is described in U.S. Pat. No. 4,498,461 and it is also referred to the BAHA® bone anchored hearing aid marketed by Entific Medical Systems in Göteborg.

Other types of bone conducting hearing aids are described in U.S. Pat. No. 4,904,233 and in Swedish patent application 0002071-9.

A common feature for the hearing aid devices which have been described so far is that some type of vibratory generating means, vibrators, are required. Different types of vibrators are well known in the art. There are a number of known vibrator principles today. In traditional as well as in bone anchored hearing aid devices it is normally used a vibrator principle which was described already by Bell in 1876. There is a detailed description of this principle applied on a bone anchored, bone conducting hearing aid device in "On Direct Bone Conduction Hearing Devices", Technical Report No. 195, Department of Applied Electronics, Chalmers University of Technology, 1990. Other vibrators of this type are described in Swedish patents 0002072-7 and 0002073-5.

In order to improve the sound quality and reduce the risk for acoustic feed back problems in the hearing aid it is necessary to damp the resonance frequency of the vibrator, i e the resonance frequency which is generated by the mass-spring system, which consists of the counter-acting mass (including coil, magnet etc), and the inner spring in the vibrator. In conventional bone conductors there is no need for any internal damping of this frequency as the skin between the vibrator and the bone has a damping function in itself. When the vibrator is connected directly to the bone, however, a significant resonance peak is generated in the frequency response characteristics which gives a poor sound quality and feedback problems.

The above-mentioned problems with the bone anchored hearing aids can be solved by providing the vibrator spring with some kind of mechanical damping. Then the original design of the spring has to be changed significantly, for instance it is changed into a sandwich structure in the form of a damping material applied between thin plates.

In this context it is referred to Swedish Patent No. 85.02426-3 in which it is illustrated a vibrator comprising a vibrator plate and a coil which is wound around a bobbin base having a core and two side walls. It also comprises means for damping the resonance frequency of the vibrator in the form of a spring provided with a layer of a damping material or a built-in damping material.

Also other types of mechanical damping means have been proposed, for instance ferro-fluid damping as described in Swedish patent application 0102206-0. In this case the gap between the vibrator plate and the bobin base, or some other spacing in the vibrator in which a relative movement between two surfaces is generated during the vibratory function, is at least partially filled with a fluid or a gel. The purpose of this fluid or gel is to provide the main part of the damping of the resonance frequency of the vibrator. Preferably the fluid or gel comprises ferro-magnetic particles, a so-called ferro-fluid, in order to keep the fluid in place and increase the magnetic conductivity in the magnetic circuit.

It has turned out that these types of vibrators with mechanical damping means in the form of a damping spring or a damping fluid not always give an optimal function of the hearing aid. The damping spring is a mechanically complicated and exposed part in the hearing aid and the ferro fluid damping is also a rather complicated technical solution.

A vibrator spring with an integrated damping in the form of a damping material or mass has also a number of disadvantages. In the first place, the damping material not only has a damping function but it also gives the spring a more uncontrolled stiffness. This is a serious disadvantage as the spring stiffness is a sensitive parameter in this type of vibrator. If the spring is too weak there is a risk for collaps, on the other hand if the spring is too rigid it has a negative effect on the overall performance. Furthermore, the damping material has a stiffness which depends on the temperature which means that the performance is seriously effected by temperature changes. If the temperature is too low, the vibrator is significantly weaker.

Also, the damping mass has a frequency dependent stiffness which means that the spring becomes more stiff at audio frequencies. This is quite in contrast to what you want as it gives an unnecessarily high resonance frequency compared to the case with no damping mass at all, which means that approximately twice as high weight has to be used in order to obtain the same resonance frequency. This is of course not acceptable in the case of small, compact devices.

Secondly, when the damping material is growing older it has a negative effect on the vibratory performance due to the fact that the resonance frequency increases with the increased stiffness of the damping mass. From a manufacturing point of view the introduction of a damping mass is not what you want. Even the reliability of the vibrator is seriously effected by the damping mass as there is a tendency that the damping mass will be creeping away after the manufacturing process which means a risk for collapse of the vibrator.

A further disadvantage with the mechanical damping is the fact that the degree of efficiency is decreased. In order to dampen the resonance peak a valuable amount of battery power is consumed just in the form of heat generation in the damping mass.

SUMMARY OF THE INVENTION

It is an object of the present invention to provide a vibrator device which has a less number of mechanically sensitive parts and which eliminates the above-mentioned disadvantages. According to the invention the vibrator in itself has no integrated, mechanical damping, instead the damping is made electronically, so that the signal processing is used for removing the frequency peak. The invention is characterised in that the signal processing circuit comprises analog or digital electronic filtering means having a frequency response which is adapted to attenuate the signal from the hearing aid microphone at the resonance frequency of the vibrator.

According to a further preferred embodiment the filter setting is adapted to each individual hearing aid apparatus in order to eliminate individual variations between different vibrators.

BRIEF DESCRIPTION OF THE DRAWINGS

According to a further preferred embodiment the filter setting is adapted to each individual hearing aid apparatus in order to eliminate individual variations between different vibrators.

In the following the invention will be described more in detail with reference to the accompanying drawings in which FIG. 1 schematically illustrates a bone-anchored hearing aid apparatus, FIG. 2 illustrate the frequency response of the hearing aid apparatus.

DETAILED DESCRIPTION OF EMBODIMENTS OF THE INVENTION

Figure 1:
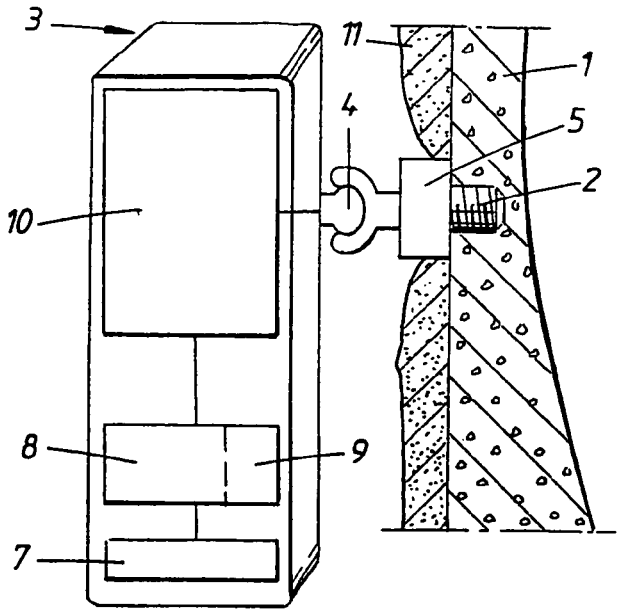

FIG. 1 illustrates the general principle for a bone-anchored hearing aid apparatus. The hearing aid apparatus is anchored directly into the skull bone, preferably into the mastoid bone 1 behind the outer ear, by means of a titanium fixture 2, for instance a titanium fixture of the type which is described in SE 002627-8. The figure shows the two main parts of the hearing aid apparatus, i e the bone anchored part and the hearing aid part 3 which is connected to the bone anchored part by means of a coupling arrangement, such as a bayonet coupling or any other type of coupling 4 based on mechanically spring member parts. The bone-anchored hearing aid part comprises, in addition to the titanium fixture, a spacer element or skin penetrating member 5 which is connected to the bone anchored titanium fixture by means of a spacer screw. The fixture is preferably made of titanium as titanium has the ability to be integrated into the surrounding bone tissue, so-called osseointegration. The hearing aid apparatus picks up the sound via a microphone 7. The signal from the microphone is amplified and filtered in the electronic unit (signal processing means) 8 which unit is powered by means of a battery 9. The amplified signal is supplied to a vibrator 10 in which the electrical signal is converted into vibrations which are transferred to the skull bone via said titanium fixture 2. Apart from the fact that the vibrator has no mechanical damping, the hearing aid part with its electronic components should be known per se and the individual components are therefore not described in any detail here.

Figure 2:
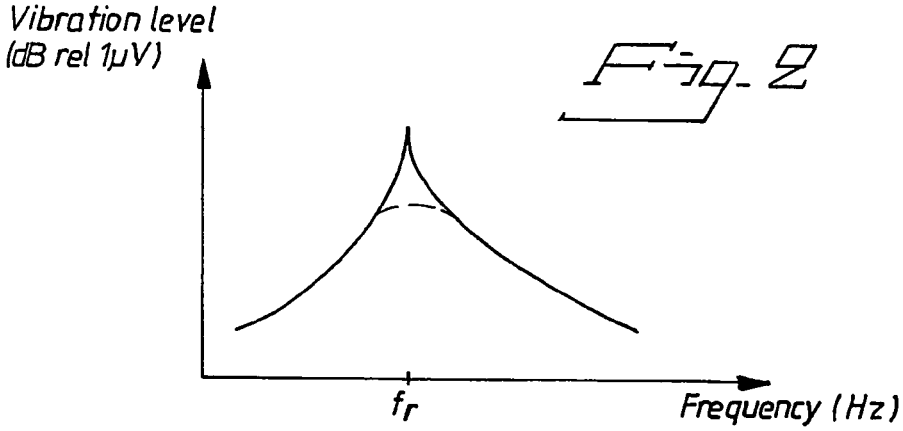

As mentioned in the introductory portion of our description it is necessary to damp the resonance frequency of the vibrator, i e the frequency which is generated in the mass-spring system which comprises the counter-acting mass (including coil, magnet etc) and the inner spring in the vibrator 10, in order to reduce the risk for feed-back problems and poor sound quality due to a deteriorated frequency response in the hearing aid apparatus. When the vibrator is connected directly to the bone, without any intermediate skin 11 as illustrated in FIG. 1, it is generated a significant, undesired resonance peak $f_r$ in the frequency response characteristics of the hearing aid apparatus, which corresponds to the resonance frequency of the vibrator, see FIG. 2. Such a resonance peak gives rise to sound quality problems as well as feed back problems and it is previously known to damp such a peak mechanically as described above and with the disadvantages introduced by these mechanically damping arrangements. The desired frequency response characteristics has been indicated by dotted lines in the figure.

Figure 3:
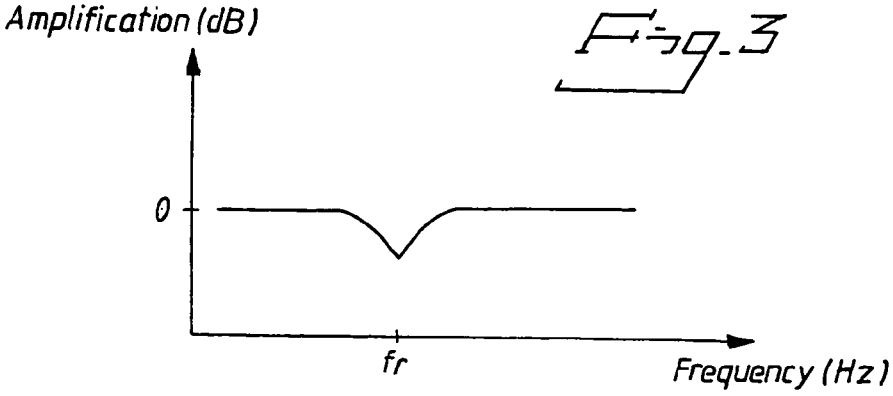
FIG. 3 illustrates the frequency response of the filtering means.

According to the invention analog or digital filtering means having a frequency response which is adapted to dampen the signal level from the hearing aid microphone just at the resonance frequency $f_r$ of the vibrator are arranged in the signal processing chain of the hearing aid apparatus. FIG. 3 illustrates the frequency response of an electronic filter arranged to reduce the amplification as much as the desired dampening of the resonance frequency. When such a filter is included into the signal processing chain a desired frequency response characteristics for the hearing aid is obtained.

Figure 4:
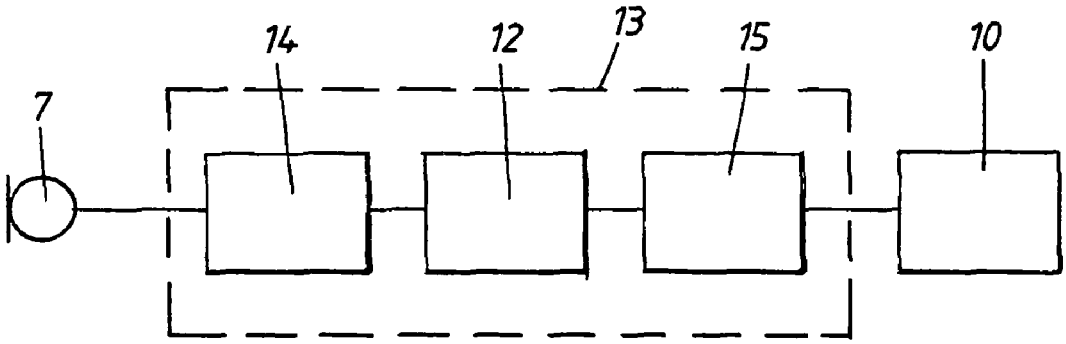
FIG. 4 illustrates an electric circuit diagram with analog signal processing comprising filtering means according to the invention.

In FIG. 4 it is illustrated an electric circuit diagram with analog signal processing means and in which the signal processing chain between the microphone 7 and the vibrator 10 includes an analog filter 12 according to the invention. Preferably, the filter 12 is included in the same physical unit 13 as the signal processing circuits in the form of an amplifier 14 and an output amplifier 15. This is the most common form of signal processing arrangement of a hearing aid apparatus today. But it is also previously known to use separate units for example the pre-amplifier and the output amplifier. The filter is included in the chain before the output amplifier in order to reduce losses in the circuit. The filter in itself can be any type of band suppression filter, a filter type which has already been used in other hearing aid applications, for instance it could be of the type Gennum GA3216. According to the invention the filter is pre-set to the desired frequency, i e the resonance frequency of the vibrator. Then there are two possibilities: Either each hearing aid apparatus is pre-programmed with a standard, pre-determined filter setting, or alternatively, each individual apparatus is measured and the filter setting is adapted to each such apparatus. This latter method eliminates possible variations between individual vibrators.

Figure 5:
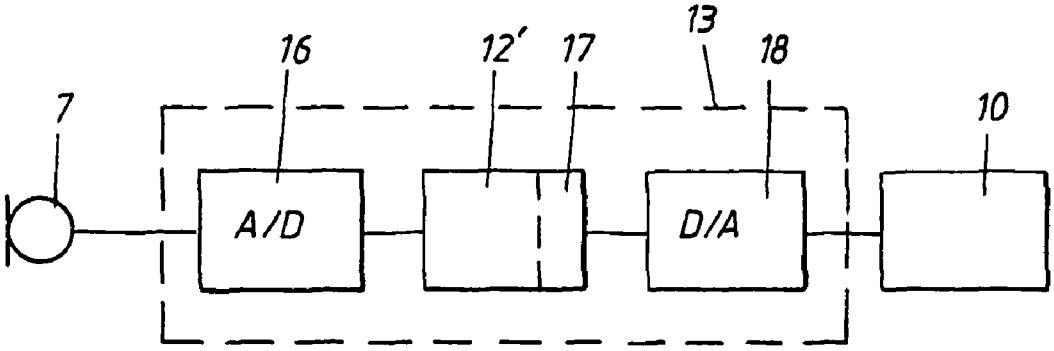
FIG. 5 illustrates a corresponding circuit diagram with digital signal processing.

In FIG. 5 it is illustrated a digital example in which a digital filter 12 is included in the signal processing chain between the microphone 7 and the vibrator 10. In this case it is included an A/D converter 16 and signal processing means 17 with the electronic filter and a D/A converter 18 including an output amplifier. So even in this case the filter circuit is included in the signal processing chain before the output amplifier. Digital band suppression filters are also known per se and will not be described in any detail here. Like the analog filter example, the digital filter setting could be pre-programmed or it could be adapted to each individual vibrator.

The invention is not limited to the embodiments which have been illustrated here but can be varied within the scope of the accompanying patent claims.

The invention claimed is:

1. A method for damping a resonance frequency in a vibrator for a bone conduction hearing aid in which sound information is mechanically transmitted via a skull bone to an inner ear of a person with impaired hearing and in which the bone conduction hearing aid comprises a microphone to pick up the sound information, a signal processor adapted to process an electrical signal from the microphone and a vibrator to convert the electrical signal into vibrations to be conducted to the skull, the method comprising:

utilizing the signal processor of the hearing aid for damping a resonance frequency peak of the vibrator by:

reducing an amplification of a first range of frequencies of the electrical signal encompassing at least a frequency corresponding to the resonance frequency of the vibrator;

maintaining an amplification of a second range of frequencies of the electrical signal, wherein the second range of frequencies is a range of frequencies lower than those of the first range of frequencies; and maintaining the amplification of a third range of frequencies of the electrical signal, wherein the third range of frequencies is a range of frequencies higher than those of the first range of frequencies.

2. The method according to claim 1, wherein the bone conduction hearing aid is pre-programmed with a standard filtering setting.

3. The method according to claim 1, further comprising measuring the bone conduction hearing aid and setting a filter setting of the bone conduction hearing aid based on the measurements.

4. A bone conduction hearing aid configured to mechanically transmit sound information via a bone to an inner ear of a person, comprising:

a sound capture device configured to capture the sound information and convert the sound information to a sound signal;

a signal processor configured to amplify and filter the sound signal; and a vibrator configured to convert the sound signal into vibrations for conduction to the bone, wherein the signal processor includes a band suppression filter, and wherein the band suppression filter suppresses a frequency corresponding to the resonance frequency of the bone conduction hearing aid, thereby damping the resonance frequency peak of the vibrator.

5. The arrangement according to claim 4, wherein the filter comprises a digital band suppression filter.

6. The arrangement according to claim 4, wherein the bone conduction hearing aid is pre-programmed with a standard filter setting.

7. The arrangement according to claim 4, wherein a filter setting of the filter is adapted to the bone conduction hearing aid.

8. The arrangement according to claim 4, wherein the signal processor includes a signal processing chain including an output amplifier, and wherein the filter is included in the signal processing chain before the output amplifier.

9. The arrangement according to claim 5, wherein the signal processor includes a signal processing chain including an output amplifier, and wherein the filter is included in the signal processing chain before the output amplifier.

10. The method of claim 1, wherein the reduction and maintenance of the amplification is performed by filtering the electronic signal.

11. The method of claim 10, wherein the filtering is performed utilizing a band suppression filter.

12. The method of claim 11, wherein the band suppression filter effectively attenuates the electrical signal at the first range of frequencies and does not effectively attenuate the electrical signal at the second range of frequencies and the third range of frequencies.

13. The bone conduction hearing aid of claim 4, wherein the band suppression filter attenuates the sound signal only at a frequency corresponding to the resonance frequency of the vibrator and those frequencies adjacent the resonance frequency of the vibrator.

14. A method for enhancing hearing of a recipient, comprising:

receiving sound information;

converting the received sound information to a sound signal representative of the received sound information;

processing the sound signal to obtain an output signal having first frequencies that are amplified to a greater extent than at least a second frequency, wherein the first frequencies include a frequency that is lower and a frequency that is higher than the second frequency; and delivering the output signal to a vibrator mechanically coupled to bone of a person, wherein the second frequency is a frequency corresponding to the resonance frequency of a device including the vibrator.

15. The method of claim 14, wherein the action of processing the sound signal to obtain the output signal includes filtering the sound signal to obtain the output signal.

16. The method of claim 14, wherein the filtering is performed utilizing a band suppression filter.

17. The method of claim 16, wherein the band suppression filter effectively attenuates the electrical signal at the second range frequency and does not effectively attenuate the electrical signal of the first frequencies.

18. The method of claim 14, further comprising attenuating the sound signal only at a frequency corresponding to the resonance frequency of the device including the vibrator and those frequencies adjacent the resonance frequency of the device including the vibrator.

* * * * *